United States Patent [19]

Agyagos

[11] 4,220,329

[45] Sep. 2, 1980

[54] EXERCISER DEVICE

[76] Inventor: Ferenc I. Agyagos, Sangin Building, 3-21-5 Akasaka, Minato-ku, Tokyo, Japan

[21] Appl. No.: 957,843

[22] Filed: Nov. 6, 1978

[30] Foreign Application Priority Data

| | | | |
|---|---|---|---|
| Dec. 16, 1977 | [JP] | Japan | 52/169248 |
| Dec. 16, 1977 | [JP] | Japan | 52/169249 |
| Feb. 3, 1978 | [JP] | Japan | 53/003741 |
| Feb. 3, 1978 | [JP] | Japan | 53/003742 |
| Feb. 3, 1978 | [JP] | Japan | 53/013247 |

[51] Int. Cl.[2] ..... A63B 21/00

[52] U.S. Cl. ..... 272/146; 128/25 R

[58] Field of Search ..... 272/146, 134, 93, DIG. 4, 272/144; 128/24 R, 25 R, 25 B

[56] References Cited

U.S. PATENT DOCUMENTS

| | | | |
|---|---|---|---|
| 1,952,830 | 3/1934 | Wrobley | 272/146 X |
| 3,384,369 | 5/1968 | Rumell | 272/146 X |
| 3,419,732 | 12/1968 | Lane | 272/730 X |
| 3,612,519 | 10/1971 | Larson | 272/146 |
| 3,659,844 | 5/1972 | Cummins | 272/134 |
| 3,911,907 | 10/1975 | Smith, Jr. | 272/146 X |

FOREIGN PATENT DOCUMENTS

| | | | |
|---|---|---|---|
| 425573 | 5/1967 | Switzerland | 272/146 |

*Primary Examiner*—John D. Yasko

*Attorney, Agent, or Firm*—Stevens, Davis, Miller & Mosher

[57] ABSTRACT

A body exercising device having two spaced, freely rotatable, removable platforms for carrying out body twisting exercises by positioning the feet on the platforms, the platforms positioned on a step-up base between two parallel hand-gripping bars for use in the performance of twisting as well as other types of exercises for conditioning of the body.

8 Claims, 4 Drawing Figures

EXERCISER DEVICE

Reference is also made to my copending application Ser. No. 957,842, filed Dec. 6, 1978.

BACKGROUND OF THE INVENTION

This invention relates to a body exercising device and is particularly directed to a device that has two horizontal, freely rotatable, removable platforms positioned between two parallel hand-gripping support bars, supported on a raised base, for use in training, twisting, and flexing of the waist, sides, hip and leg regions of the user; and when the platforms are removed, other types of calisthenics can be performed.

There are many types of exercise devices known to the art that employ a rotatable platform or platforms. These devices are constructed so that they are limited to only one or two forms of twisting and turning of the body. With the advent of greater emphasis on the need for general all-round exercise programs, such as light calisthenics, the prior art devices are not sufficiently versatile and several pieces of apparatus have to be used requiring considerable space for use and storage. The present invention solves such problems by a novel device that can be placed in the home or office of a user and will provide several different types of exercise while utilizing only a small space, which is an improvement over the art.

SUMMARY OF THE INVENTION

The exerciser device of this invention has a step-up elevated body support base with two horizontal platforms that are both freely rotatable and removable, spaced between raised parallel hand-gripping bars that are positioned on the top surface of the base for providing the user a variety of different types of exercises which can be accomplished, such as twisting, using the parallel bars to support body manipulation either with or without using the rotatable platform, and supportive in-place running and jumping when the removable platforms are removed from the base.

The operation of the device will provide the user with exercise of the waist, sides, hips and legs as well as muscle toning, all while in a standing position on the device. The elevated base is of a rectangular box-like shape with the surface containing a pair of removable circular rotating platforms. Each platform is rotatably positioned in the base by inserting a hub or turning shaft protruding from beneath the lower center of each platform, into a vertical socket or opening positioned in the top of a supporting base.

To facilitate the turning function of the rotating platforms, a set of pipe bushings can be inserted into vertical openings in the base, which in turn house a pair of round or cylindrical bars arranged in the openings so that the top ends of the bars provide a smooth bearing surface upon which the ends of the hubs of the platforms rotate so that movement of the platforms encounters little resistance. The freely turning platforms enhance the ability of the user to twist and turn. This hub and turning bar arrangement also reduces friction and noise and provides a smooth turning when body weight is applied, the platform rotating as directed by the directional movement of the feet of a user, thus producing various turn differentials of a circular degree with relative ease.

The vertical alignment of the hub in the opening and the depth of the hub should be such that the bottom surface of the rotating platform does not rub against the top surface of the supporting base when weighted by a user so as not to impair the free rotational movement of the platform.

If the device is to be used for exercises not requiring twisting, the rotatable platforms may be readily removed from the device and other types of exercise may be practiced, such as those that require the use of the raised base and the hand-gripping parallel bars.

It will be appreciated that by maintaining the supporting base at a reasonable step height from the floor, there is provided an additional exercising function of the device on which one can perform parallel bar manipulation, jumping and running up and down without forward movement, and a variety of running-in-place exercises.

Positioned adjacent to the outside of the platform and attached to the supporting base are the pair of parallel hand gripping bars which may be of U-shaped configuration and may be made from pipe members which serve as hand grips for the performance of free-hand and other related calisthenics and which provide a firm vertical support of the body when performing any of the aforementioned exercises. In addition, these parallel hand-gripping bars may be individually adjusted to accommodate users of different heights. It has also been found that a cassette tape recorder apparatus operatively positioned in the device enhances the performance of more organized and appropriate calisthenics through a set of programmed exercising patterns and rhythms and instruction.

Accordingly, one object of the present invention is to provide an exerciser for enabling the performance of the twisting, turning and flexing exercises of the waist, sides, hip and leg regions.

Another object is to provide an exerciser device which enables the performance of the jumping and running exercises by using the supporting base assembly.

Still another object is to provide an exerciser device which can entertain the performance of a great variety of individually devised or designed exercises, including parallel bar exercises.

An additional object is to provide an exerciser device with sound instructional means for guiding a user through a series of exercises or regimen.

All of the foregoing objectives are achieved with an exerciser device that is characterized by simple and reliable, sturdy lightweight construction, smooth operation, and an appealing configuration, and one which provides firm vertical support for multiple movement exercises but still occupies a small space.

BRIEF DESCRIPTION OF THE DRAWINGS

The foregoing and other objects and features of this invention can be appreciated from the following description and claims taken in conjunction with the accompanying drawings, in which:

DESCRIPTION OF PREFERRED EMBODIMENT

Figure 1:
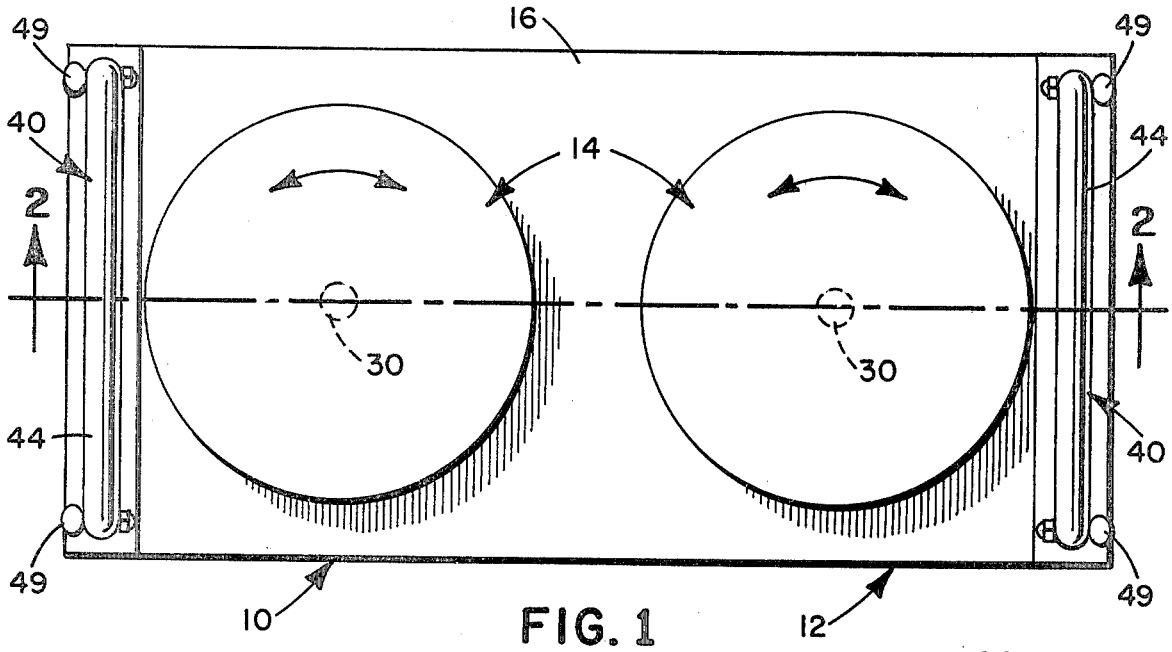
FIG. 1 is a top plan view of an exerciser device in accordance with the invention.
Figure 2:
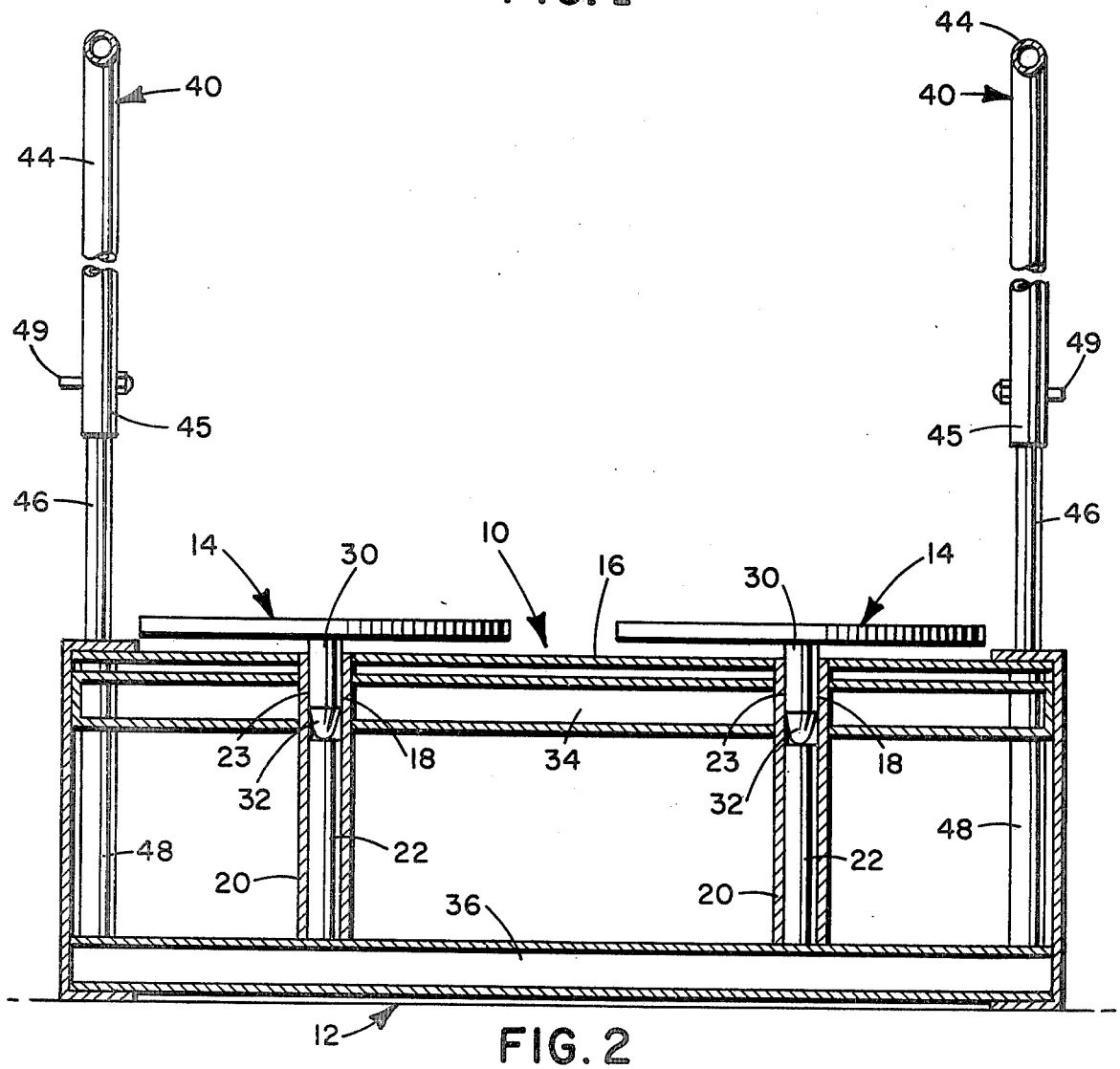
FIG. 2 is a view in elevation of the exerciser device along line 2—2 of FIG. 1.

Reference is now directed to FIGS. 1 and 2 which illustrate an exerciser device 10 constructed in accordance with the invention, having a rectangular raised supporting base member 12 and a pair of removable rotating platforms 14 symmetrically positioned on surface 16 of the base 12, each platform freely rotatable clockwise and counterclockwise by body motion of the user. Positioned on the surface 16 of the supporting base 12 are a pair of circular openings or sockets 18 in the form of cylindrical elongated bushings 20 which house a pair of rotating bars or bearing surface means 22 which are of a length shorter than the depth of bushing 20 to define a circular insertion hole 23. Centrally positioned on the back of each circular platform 14 and unitary therewith is a turning shaft or hub 30 of a diameter adapted to fit in insertion hole 23 and freely turn therein. The end 32 of the turning shaft bears on the upper face of rotating bar 22, and when the turning shaft is placed in hole 23, the platform is rotatable to enable a user to perform twisting exercises of the waist, sides, hips and legs when the user's feet are on the top surface 16 of the platforms 14.

The depth of said hole 23 is slightly less in comparison to the length of said turning shaft or hub 30 so as to provide sufficient clearance between the bottom of the platform 14 and the surface 16 of the supporting base 12 but of sufficient depth to assure that the platform will remain in place even under the most vigorous turning exercising conditions.

Auxiliary supporting or reinforcing struts or braces 34 and 35 strengthen the base of the device and greatly enhance its capacity to accommodate vigorous exercises performed by persons of greatly different weights. The lower supporting strut 36 also maintains the bushings 20 and the rotation bars 22 in their proper place (see FIGS. 1 and 2).

Figure 3:
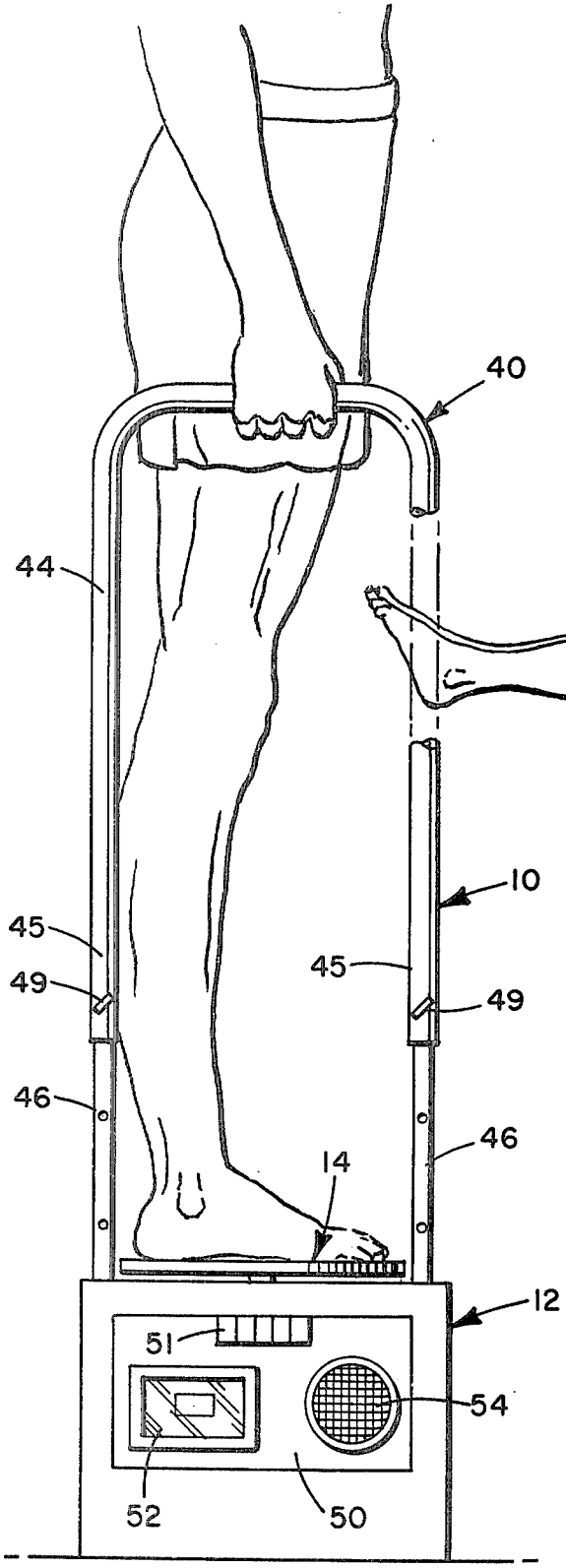
FIGS. 3 and 4 are partial depictive representational views of some of the twisting and free lance exercise variations performable on the device of this invention.
Figure 4:
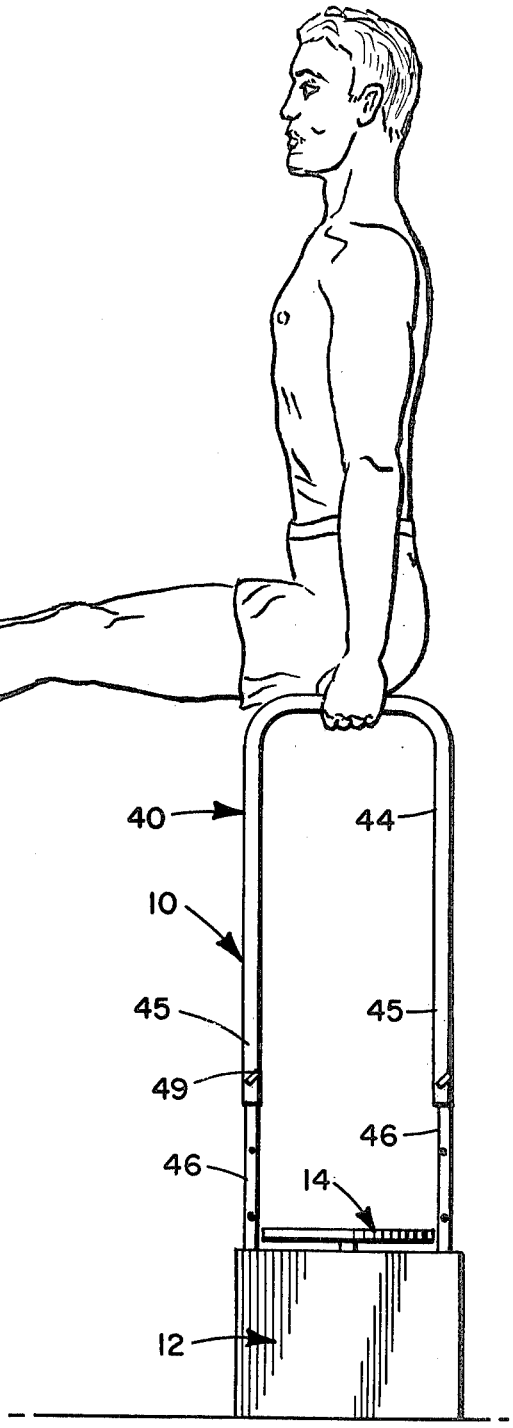

A pair of parallel hand-gripping support bars 40 used in the performance of free hand exercises as illustrated by FIGS. 3 and 4 render a firm vertical support in the performance of such exercises. The support bars are attached to the surface of the base 12, the support bars being arranged opposite each other and the two rotatable platforms being spaced one from the other between the support bars. The support bar may consist of an inverted U-shaped pipe member 44 having telescoping fitted joint 45 which telescopingly engages a vertical straight pipe 46 which extends from below the surface of the base and which is further connected to a supporting pipe 48 which is connected to the supporting strut 36. The telescoping inverted U-shaped pipe member 44 can be detached, re-attached, or adjusted to the desired height with ease and retained in fixed adjusted position by locking means or detents 49 engaging holes spaced along the pipe 46.

Positioned in a side of the exerciser device 10 is sound projection means in the form of a conventional cassette tape recorder 50 (see FIG. 3) for playing a variety of programmed exercising tapes containing exercise patterns, rhythms, and/or instruction, or musical variations to make the exercise period more enjoyable. The sound projection means, which can be powered by a battery or by electrical current supplied from an electrical outlet passing through a plug and extension cord to the projection means, is operatively connected to the base 12 and has manipulative buttons or controls 51 for controlling the operation of the sound projection means and a speaker 54 positioned in the base for broadcasting the sound recorded on tapes 52 placed in the sound projection means 50.

It should be understood that many modifications and variations in the particular embodiments of the invention can be made and the scope of the invention is limited only by the appended claims.

What is claimed is:

1. An exerciser device for exercising the body or a user comprising: a raised supporting base member; two spaced horizontally and freely rotatable removable platforms, each said platform being rotatable either clockwise or counter-clockwise independent of the other and each having a fixed vertical downwardly extending turning shaft; two spaced parallel socket means positioned in the top of said base member, each socket means adapted to removably receive one of said turning shafts when positioned in said socket means and to retain the platforms spaced above the top of said base member to provide a pair of horizontally-positioned spaced platforms independently rotatable with respect to each other and to said base by motion of the body of the user; and a parallel pair of hand gripping support bars attached to and extending upward from said base, one on each side of said pair of independently rotatable platforms.

2. The exerciser device of claim 1, in which a sound projection means is operatively positioned in said base, said projection means hving manually operated controls for providing sound communication to the user of programmed exercising patterns, rhythms, and instructions.

3. The exerciser device of claim 2, in which said sound projection means is a tape recorder.

4. The exerciser device of claim 1, in which said parallel pair of hand gripping support bars each has adjustable portions therein for raising or lowering the height of the support bar.

5. The exerciser device of claim 1, in which said parallel pair of hand gripping support bars is detachably assembled to said base.

6. The exerciser device of claim 4, in which said hand gripping support bars are of a telescoping inverted U-shape with the legs of the U-shaped telescoping bar members having means for height adjustment.

7. The exerciser device of claim 1, in which said socket means has a turnable thrust surface in each opening against which the end of a turning shaft operatively connected to said base rests and turns during the rotational movement of said platform by body motion of the user.

8. The exerciser device of claim 1, in which said base is a rectangular box-like structure having supporting strut members in the bottom, top, and sides thereof to support the weight of persons stepping on and jumping up and down on said base.

* * * * *